United States Patent [19]

Jensen et al.

[11] Patent Number: 4,516,915

[45] Date of Patent: May 14, 1985

[54] PUMPING PLANT

[75] Inventors: N. Due Jensen; K. Frank Nielsen, both of Bjerringbro, Denmark

[73] Assignee: Grundfos A/S, Bjerringbro, Denmark

[21] Appl. No.: 473,943

[22] Filed: Mar. 10, 1983

[30] Foreign Application Priority Data

Mar. 24, 1982 [DE] Fed. Rep. of Germany ..... 3210761

[51] Int. Cl.[3] ..... F04B 17/00; F04B 35/04; H02K 5/132

[52] U.S. Cl. ..... 417/365; 417/366; 417/423 R; 310/87

[58] Field of Search ..... 415/140, 34, 170 A, 415/170 B, 107, 106, 131, 132; 417/365, 366, 423 R; 310/86, 87, 90

[56] References Cited

U.S. PATENT DOCUMENTS 4,042,847 8/1977 Jensen ..... 310/87

FOREIGN PATENT DOCUMENTS 2529399 1/1977 Fed. Rep. of Germany ..... 417/366
468740 1/1952 Italy ..... 415/106

*Primary Examiner*—Carlton R. Croyle
*Assistant Examiner*—T. Olds
*Attorney, Agent, or Firm*—Balogh, Osann, Kramer, Dvorak, Genova & Traub

[57] ABSTRACT

The invention relates to a pumping set for plants carrying water, comprising a split-tube motor and a rotary pump driven by the same, the impeller of which is located on the extremity of the shaft present in the pumping space, said shaft being carried by two radial anti-friction bearings situated at either side of the rotor stack of laminations, and consists of ceramic material at least in the area of these anti-friction bearings and is longitudinally movable with respect to the ceramic bearing rings of the radial anti-friction bearings under forces acting axially on the impeller, the maximum length of this longitudinal displacement being limited by two axial anti-friction bearings. An annular groove is provided in the shaft directly adjacent to each of the two bearing areas of the radial anti-friction bearings, that is to say in each case adjacent the extremity of these bearing areas directed towards the impeller, and that the said distance is smaller than the width of the annular grooves.

1 Claim, 2 Drawing Figures

PUMPING PLANT

BACKGROUND OF THE INVENTION

The present invention relates to a pumping plant for installations carrying water, comprising a split-tube motor and a rotary pump driven by the same, the impeller of which is situated on the shaft extremity present within the pump space, which is carried by two radial anti-friction bearings situated at either side of the rotor stack of laminations, said shaft consisting of ceramic material at least in the area of these anti-friction bearings and is longitudinally movable with respect to the ceramic bearing rings of the radial anti-friction bearings under forces acting axially on the impeller, the maximum length x of this longitudinal displacement being limited by two axial anti-friction bearings.

Depending on its source and place or origin, the water from the conventional water supply mains contains greater or lesser proportions of admixtures which may lead to corrosion or calcification of the plant. Breakdowns of the pumping plant are caused less by corrosion than primarily by calcareous deposits commonly caused by calcium hydrocarbonate ($Ca(HCO_3)_2$) which when the water is heated precipitates as insoluble calcium carbonate $CaCO_3$ and forms the so-called boiler scale.

This calcium carbonate also settles as a coating on the periphery of the pump shaft so that the coating is drawn into the radial anti-friction bearings carrying the shaft during axial movements of the shaft, which frequently results in seizing of the shaft. Moreover, longitudinally directed displacement movements of the shaft are unavoidable in the case of faucet water installations. For example, they are caused by sudden opening of water cocks since the forces caused thereby act in surging manner on the pump impeller and displace the same axially together with the shaft, that is from a position decisive for the case of stationary or static operation into a non-stationary position from which the shaft finally returns automatically to the initial position after termination of the energy pulse.

The axial freedom of the shaft between the two positions is rendered possible moreover by the production technique applied in each instance and in particular also by the axial compressibility of the resilient seals, and last but not least is also needed to avoid excessive stress on the shaft. The maximum length of the axial shaft displacement is however determined and limited in finite manner by two axial bearings.

Under the given circumstances, no possibility is thus available in this case of simply precluding the previously referred to risk of shaft seizure simply by preventing any axial freedom of the shaft, so that in the case of the arrangements hitherto known, it had always had to be expected that deposits or coatings present on the shaft periphery would be pulled into the radial bearings during an axial shaft displacement.

It is an object of the invention to provide an uncomplicated as well as economical solution to this problem, consisting in the manner in which a shaft seizure in the radial anti-friction bearings may be precluded despite the unavoidable deposits on the shaft periphery.

SUMMARY OF THE INVENTION

To resolve this and other problems, the pumping plant referred to in the foregoing is adopted as a basis and is so developed in accordance with the invention, that an annular groove is formed in the shaft right beside each of the two bearing areas of the radial anti-friction bearings, that is to say in each case adjacent the extremity of these bearing areas directed towards the impeller, and that the maximum length of the longitudinal shaft displacement is smaller than the width of the radial anti-friction bearings and also smaller than the width of the annular grooves.

During stationary or constant operation, the anti-friction surfaces of both radial bearing rings may bear fully on the peripheral portion of the shaft in question, when it should not be expected that particles present in the water could penetrate in decisive degree into bearing interstices and cause trouble. A coating will however be deposited on the shaft to the left and right of the bearing surfaces. In this connection, only one coating could become critical however in respect of an axial shaft displacement, namely that which is drawn into the bearing gaps during this shaft displacement in the one direction which is determined by transition from the stationary to the non-stationary mode of operation. This coating will however be deposited in the annular grooves in accordance with the solution specified, that is at a level which is radially lower or in other words situated closer to the centre of the shaft than the directly adjacent shaft periphery in the area of the bearing, so that no coating will penetrate into the bearing gaps during a shaft displacement in the one direction in question.

Since the annular grooves will partially have penetrated into the radial bearing rings in the non-stationary mode of operation, these bearing rings will no longer bear fully on the shaft periphery, so that it may be expected that the radial bearings will no longer operate in a hydrodynamic lubrication mode without contact between the friction surfaces but in a composite friction mode. Apart from the fact that the non-stationary operating condition occurs but briefly and that no bearing damage need be feared on this score, this state however still offers the advantage that deposits possibly still present in the bearing gaps may be ground down and finally flushed out by the water.

BRIEF DESCRIPTION OF THE DRAWINGS

In order that the invention may be more clearly understood, reference will now be made to the accompanying drawings which illustrate one embodiment thereof by way of example only and in which.

DETAILED DESCRIPTION OF THE PREFERRED EMBODIMENT

Figure 1:
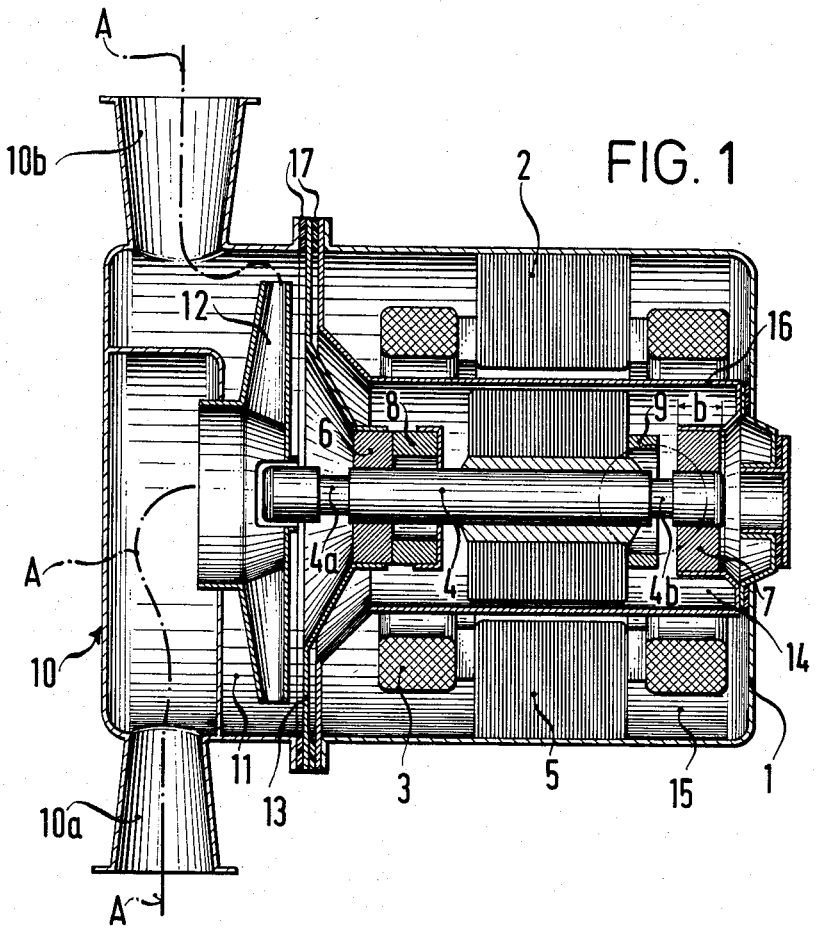
FIG. 1 shows a diagrammatical and simplified longitudinal cross-section through a pumping plant.
Figure 2:
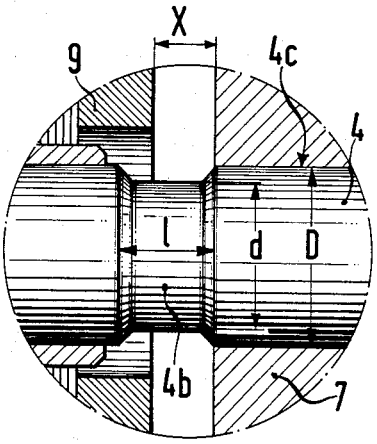
FIG. 2 shows the part enclosed by a circle in FIG. 1, to an enlarged scale.

Referring now to the drawings, a stator 2 substantially comprising a stack of laminations 5, and windings 3, and a rotor and its parts, are situated in the housing 1 of a split-tube motor. Said parts include the shaft 4 having radial anti-friction bearings 6,7 supporting it at either side of the rotor stack of laminations 5. In accordance with the drawing, annular grooves **4*a* and 4*b* are provided at the left beside the two bearing rings or radial anti-friction bearings 6, 7** in the shaft.

A casing 10 of the rotary pump surrounds a pumping space 11 into which leads one extremity of the shaft 4, upon which is situated an impeller 12. A partition 13 is provided between the pumping space 11 and the motor compartment. A rotor space 14 filled with water is separated from a dry stator space 15 in liquid tight manner by means of a split tube 16.

The water is conveyed through the pump casing 10 in the direction illustrated by the arrows A. Said water thus enters through an intake connector 10*a* and passes via the impeller 12 to a delivery connector 10*b*, where it emerges from the pump casing again. These and other functions as well as structural features of such pumping sets are generally known, so that no further explanation seems to be needed. In this connection, reference is consequently merely still made to previously known pumping sets as described and illustrated, amongst others, in the German Offenlegunggung Specification Nos. 25 16 575, 25 29 399 and 26 39 541.

During the normal stationary operation occurring without large water pressure fluctuations, the shaft 4 has the position shown in FIG. 1, in which the bearing ring 8 of the pump-side axial bearing bears on the opposed ground end surface of the radial bearing ring 6. A distance x is then present between the other radial bearing ring 7 and the axial bearing ring 9 situated on the rotor, which is determined by production tolerances and by the fit of the flat packings 17 situated between the pump casing 10 and the split tube 16. This distance x represents the maximum distance through which the shaft 4 may move towards the right from the position illustrated. Moreover, the effective ratio between the width and diameter of the radial bearings amounts to b/D, b being the axially measured width of the radial bearing rings 6, 7 and D being the diameter of the shaft 4 in the bearing area.

If water is suddenly drawn from the water installation, surge forces are generated as known, which may act in such manner that the impeller 12 and perforce also the shaft 4 are displaced towards the right (FIG. 1), the actually travelled length of displacement normally corresponding to the distance x and the bearing 9 thus coming into contact against the opposed end face of the bearing ring 7. At the same time, the annular grooves 4*a* and 4*b* present in the shaft 4 travel out of the position shown in FIG. 1 for the case of stationary operation and partially into the radial bearing rings 6, 7, without deposits on the shaft thereby being entrainable into the bearing gaps, since the deposits critical in this respect are actually situated on the groove surface and thus at a low level than the bearing gap. A new relationship between the width and diameter at the radial bearings now evidently prevails as compared to the case of stationary operation which will amount to $(b-x)/D$ in the limiting case, that is when the shaft 4 has been displaced towards the right through the whole distance x.

Whereas during stationary operation according to FIG. 1, the radial bearings 6, 7 may bear across the full width of the bearing ring friction surfaces and may operate in the hydrodynamic lubrication mode without contact between the friction surfaces, the two radial bearings will run in the composite friction mode because of the lesser effective bearing surface when the shaft 4 is displaced towards the right during non-stationary operation. Since, however, the shaft 4 in the bearing areas at least, as well as the bearing rings 6, 7 should be produced from hard oxide ceramics, the brief operation in composite friction mode does not raise any risk to the bearings. As already stated in the preamble above, the state of composite friction may if applicable still offer advantages inasmuch as deposits present on the friction surface 4*c* of the shaft 4 which may possibly nevertheless have been formed during normal stationary operation, may be ground down between the friction surfaces and finally removed with the water.

It is understandable moreover that the permissible distance x for the axial displacement of the shaft 4 should be smaller than the width b of the radial bearing rings 6, 7 as well as smaller than the width or length l of the annular grooves 4*a* 4*b*, so that an adequate overlap still prevails between the bearing ring friction surfaces and the shaft periphery in the case of non-stationary operation. Say the following conditions may apply as guidelines for the dimensioning of the distances and diameters in question, being $0.5 \leqq x/l \leqq 0.9$ and $0.1 \leqq x/b \leqq 0.8$. The relationship $0.5 \leqq d/D \leqq 0.9$ may be applicable for the diameter d measured across the groove bottom and for the shaft diameter D in the bearing area.

In conclusion, it is also pointed out that the solution according to the invention may in principle be applied in all water-carrying installations, if the problems described in the foregoing arise in such installations. In particular, this will be the case in heating and faucet water plants.

We claim:

1. In a pumping plant for installations carrying water, comprising a split-tube motor and for driving a centrifugal pump and having an impeller which is located on the extremity of a shaft present in the pumping space, said shaft being borne by two radial anti-friction bearings located at either side of a stack of laminations of said rotor and said shaft consisting of ceramic material at least in the area of said anti-friction bearings and being longitudinally movable with respect to said ceramic bearing rings of the radial anti-friction bearings under forces acting axially on the impeller, the maximum length x of this longitudinal displacement being delimited by two axial anti-friction bearings, the invention which consists in that an annular groove is situated in each case right beside said two bearing areas of said two radial anti-friction bearings in said shaft, that is to say, in each case adjacent the extremity of said bearing areas directed towards the impeller, and that said length x is smaller than the width b of said radial anti-friction bearings and also smaller than the width l of said annular grooves, wherein the following relationship is obtained:

$$0.5 \leqq d/D \leqq 0.9$$

$$0.5 \leqq x/l \leqq 0.9$$

$$0.1 \leqq x/b \leqq 0.8$$

wherein, d = diameter of the annular grooves, as measured along the bottom of the grooves, D = diameter of the shaft in the area supporting the radial bearing, l = width of the annular grooves, b = width of the bearing surface of the radial anti-friction bearings.

* * * * *